US006485381B1

(12) United States Patent
Pai

(10) Patent No.: US 6,485,381 B1
(45) Date of Patent: Nov. 26, 2002

(54) HANDLE AND NECK FOR A RACKET

(76) Inventor: Chin-Dong Pai, 20-3 Fl. No. 123, Sec. 3, Jonggang Rd., Taichung (TW)

( * ) Notice: Subject to any disclaimer, the term of this patent is extended or adjusted under 35 U.S.C. 154(b) by 0 days.

(21) Appl. No.: 09/966,111

(22) Filed: Oct. 1, 2001

(51) Int. Cl.[7] ..... H63B 49/02; A63B 49/08
(52) U.S. Cl. ..... 473/521; 473/549
(58) Field of Search ..... 473/520, 521, 473/524, 546, 531, 532, 545, 549

(56) References Cited

U.S. PATENT DOCUMENTS

| | | | | | |
|---|---|---|---|---|---|
| 537,927 | A | * | 4/1895 | Kennedy | 473/520 |
| 546,540 | A | * | 9/1895 | Kennedy | 473/520 |
| 1,897,515 | A | * | 2/1933 | Hedstrom | 473/524 |
| 4,007,929 | A | * | 2/1977 | Figa | 403/348 |
| 4,052,060 | A | * | 10/1977 | Balkcom | 473/531 |
| 4,139,194 | A | * | 2/1979 | Fischer | 473/521 |
| 5,560,600 | A | * | 10/1996 | FitzSimons et al. | 473/463 |
| 5,749,574 | A | * | 5/1998 | Curtis | 473/531 |
| 5,816,960 | A | * | 10/1998 | Svoma et al. | 473/549 |
| 2002/0086747 | A1 | * | 7/2002 | Hsu | 473/520 |

FOREIGN PATENT DOCUMENTS

| | | | | |
|---|---|---|---|---|
| FR | 786361 | * | 6/1935 | 473/FOR 177 |
| FR | 2547506 | * | 12/1984 | 473/FOR 183 |
| FR | 2590802 | * | 6/1987 | 473/FOR 183 |
| FR | 2617405 | * | 1/1989 | 473/FOR 171 |
| WO | 91/09652 | * | 7/1991 | 473/FOR 171 |

* cited by examiner

*Primary Examiner*—Raleigh W. Chiu
(74) *Attorney, Agent, or Firm*—Jones, Tullar & Cooper, P.C.

(57) ABSTRACT

A sport racket includes a neck and a handle. The neck has an outer tapered wall provided with an outer bottom formed with the outer tapered wall; and an inner tapered wall provided with an inner bottom formed with the inner tapered wall. The handle has a tapered wall defining an open chamber to receive the outer bottom of the neck; an elastomer securely abutting a bottom defining the chamber; and a threaded bolt extending through the inner bottom, the outer bottom, the bottom of the chamber and the elastomer to screw into a nut.

6 Claims, 4 Drawing Sheets

HANDLE AND NECK FOR A RACKET

BACKGROUND OF THE INVENTION

1. Field of the Invention

The present invention relates to a handle and a neck for a racket, and more particularly to a handle detachably connected to a neck of a racket so that a damper can be mounted between the handle and the neck to absorb shock and vibration and prevent transmission of the shock and vibration to the player's hand.

2. Description of Related Art

The physical characteristics of a racket such as the weight, the balance, the length and the size of the handle, etc. are crucial to a player. Another important factor to the player is the rigidity of the racket. Some players prefer a rigid racket, and some players prefer a racket with more flexibility. No matter how different the characteristics of individual rackets may be, after the racket is produced, the rigidity of the racket is fixed, and the player has no way to adjust the rigidity. Because of the fixed rigidity of the racket, the player will have to adjust his playing techniques to the particular court whenever the player goes to a new court. To mitigate the problem, having a racket with adjustable rigidity seems to be the solution to overcome the problems caused by different court characteristics. With reference to FIG. 4A, the joint between a conventional neck (50) and a conventional handle (60) with a grip (61) has a resilient transition element (62) mounted between the bottom of the neck (50) and the top of the handle (60) and a collar (63) mounted over outer peripheral edges of the neck (50) and the handle (60) to cover the resilient transition element (62). With such an arrangement, whenever the player swings the racket, the shock and vibration from the racket is able to be absorbed by the resilient transition element (62). Thus injury to the player's wrist is prevented. However, even a racket provided with the resilient transition element (62) has a fixed rigidity, which means the player still has to practice in advance and adjust his playing techniques to accommodate the features of a strange court. Furthermore, the engagement of the elements of the structure is based on the expansion of the resilient transient element (62), which causes a friction in a longitudinal direction of the racket. This engagement between elements is not solid.

With reference to FIG. 4B, another conventional neck (70) and handle (80) is shown. It is noted that the bolt (71) extends through the elastomer (90) which is received between the joint of the neck (70) and the handle (80) to securely connect the handle (80) to the neck (70). The elastomer (90) will push the handle (80) away from the neck (70) so the structure is not able to have a good shock absorbing effect and a firm structure at the same time.

To overcome the shortcomings, the present invention tends to provide an improved neck and handle of a racket to mitigate and obviate the aforementioned problems.

SUMMARY OF THE INVENTION

The primary objective of the invention is to provide an elastomer having an adjustable flexibility in the handle so that the player is able to adjust the rigidity of the racket when required.

Another objective of the invention is to provide a neck with tapered walls and a handle with a tapered chamber complementary to the tapered walls to receive the tapered walls of the neck. With such an arrangement, the engagement between the neck and the handle will not detach easily.

Other objectives, advantages and novel features of the invention will become more apparent from the following detailed description when taken in conjunction with the accompanying drawings

DETAILED DESCRIPTION OF THE PREFERRED EMBODIMENT

Figure 1:
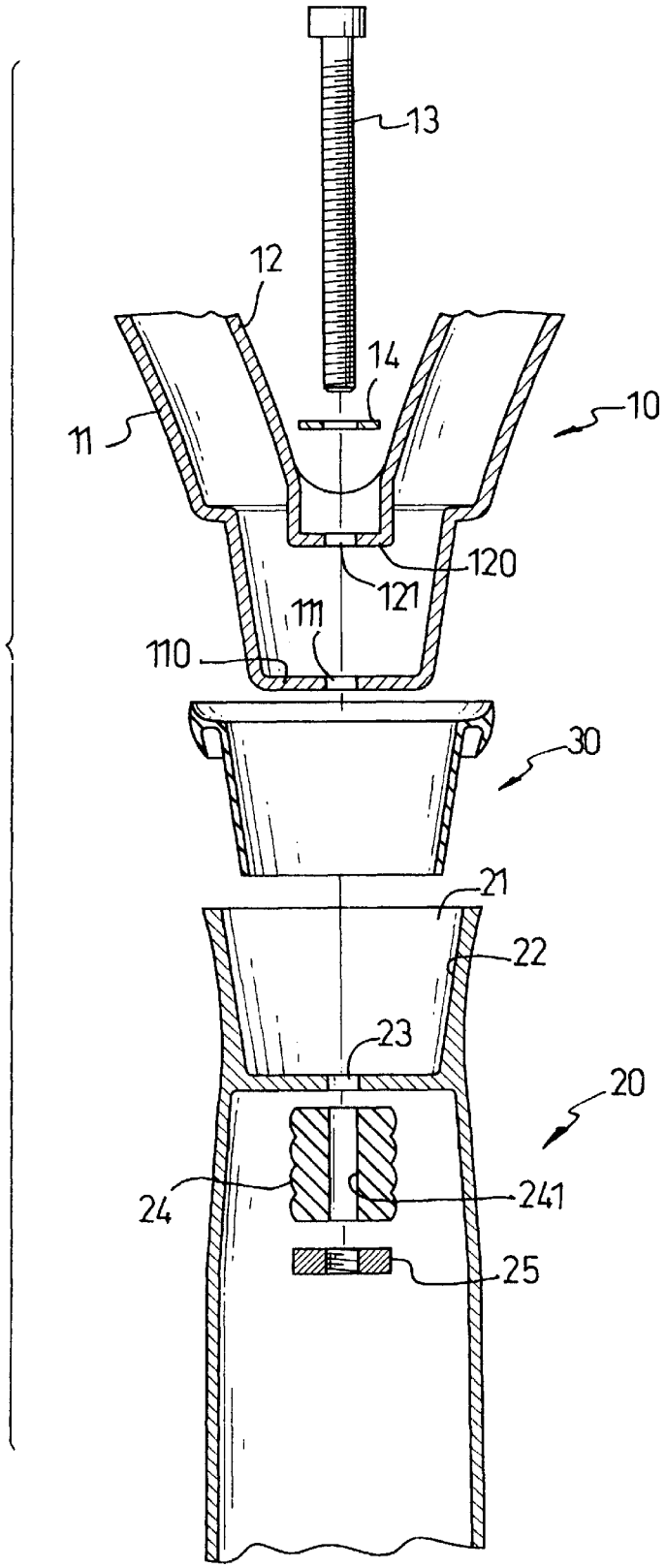
FIG. 1 is an exploded cross sectional front plan view of the neck and the handle in accordance with the present invention, wherein an elastomer is received in the handle.
Figure 2:
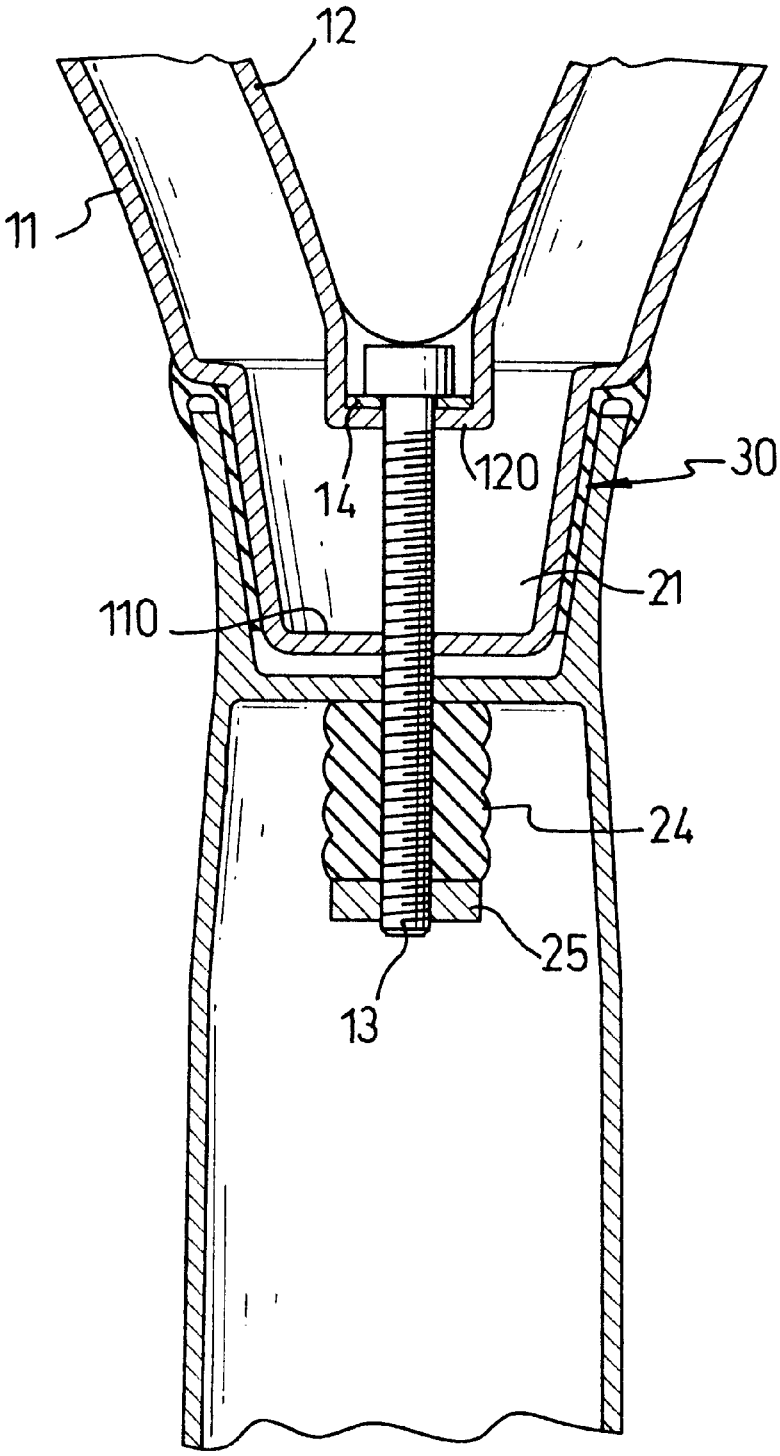
FIG. 2 is a front plan view in partial section of the neck and the handle in FIG. 1.

With reference to FIG. 1, a tubular neck (10) and a tubular handle (20) in accordance with the present invention are joined to form a racket. The neck (10) is a hollow tube and has outer and inner tapered walls (11,12) extending downward to the handle (20) and join together to form an outer bottom (110) and an inner bottom (120) respectively. An outer through hole (111) is defined in the outer bottom (110), and an inner through hole (121) is defined in the inner bottom (120) to align with the first through hole (111). A threaded bolt (13) extends through a washer (14), the inner through hole (121) and the outer through hole (111). The washer (14) prevents damage to the inner bottom (12) by the threaded bolt (13).

The handle (20) is tubular and has two ends and an open chamber (21) with a bottom and an interior tapered sidewall (22). A through hole (23) is defined in the bottom of the chamber (21) to align with the outer through hole (111) in the neck (10). An elastomer (24) is mounted inside the handle (20) and has a channel (241) defined to align with the through hole (23) in the chamber (21) so that after the threaded bolt (13) extends through the inner through hole (121), the outer through hole (111) and the through hole (23) in the chamber (21), the threaded bolt (13) is able to extend through the channel (241) to screw into a nut (25). Therefore, the elastomer (24) is securely mounted in the handle (20) to function as a shock absorber to prevent injury to the player's wrist.

The outer tapered wall (11) of the neck (10) mates with the tapered wall (22) in the chamber (21) of the handle (20) to form a secure connection between the neck (10) and the handle (20) such that the connection between the neck (10) and the handle (20) will not easily become loose.

To further enhance the connection between the neck (10) and the handle (20), an elastic annular cushion (30) is mounted between the neck (10) and the handle (20). The annular cushion (30) is configured to correspond to the tapered sidewall (22) of the handle (20). After the annular cushion (30) is mounted in the chamber (21) of the handle (20), the annular cushion (30) is able to abut a sidewall (22) defining the chamber (21). Therefore, when the outer tapered wall (11) of the neck (10) is inserted into the chamber (21), the outer tapered wall (11) is able to completely contact the annular cushion (30). With the annular cushion (30) between the neck (10) and the handle (20), much of the shock from a head of the racket is absorbed by the annular cushion (30).

Moreover, the rigidity of the elastomer (24) in the handle (20) is adjustable. The player only needs to tighten or loosen the threaded bolt (13) to adjust the engagement with the nut (25), and the rigidity of the elastomer (24) is adjusted so that the player is able to cope with different features of different courts.

Figure 3:
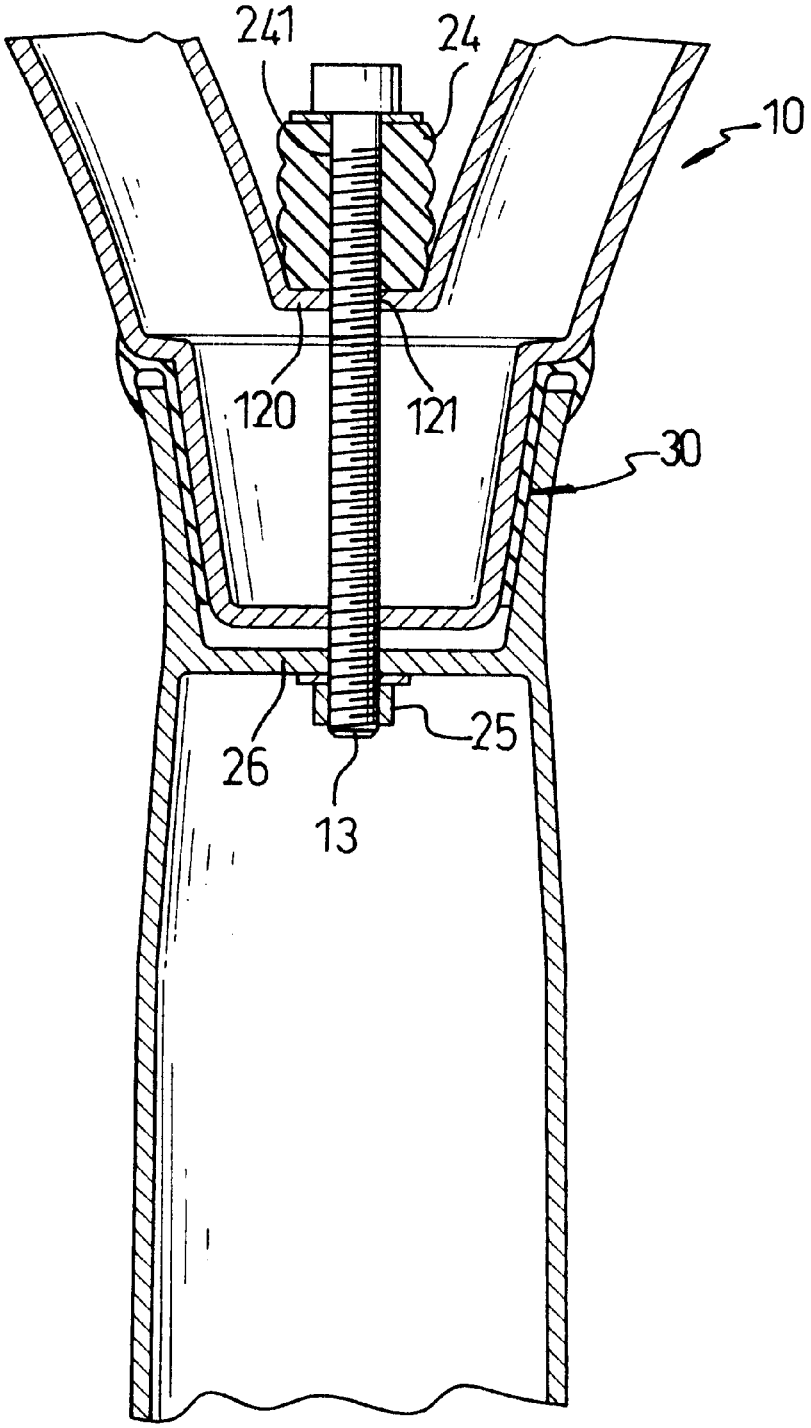
FIG. 3 is a front plan view in partial section of the neck and the handle in accordance with the present invention, wherein the elastomer is received in the neck
Figure 4B:
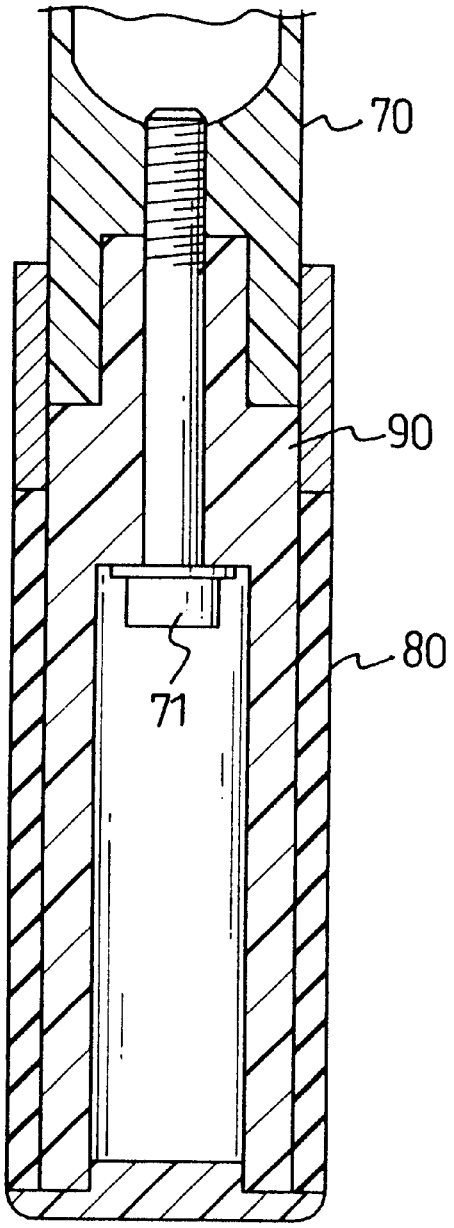
FIG.4B PRIOR ART
FIG. 4 is a cross sectional front plan view of a conventional neck and a conventional handle in accordance with the prior art.
Figure 4A:
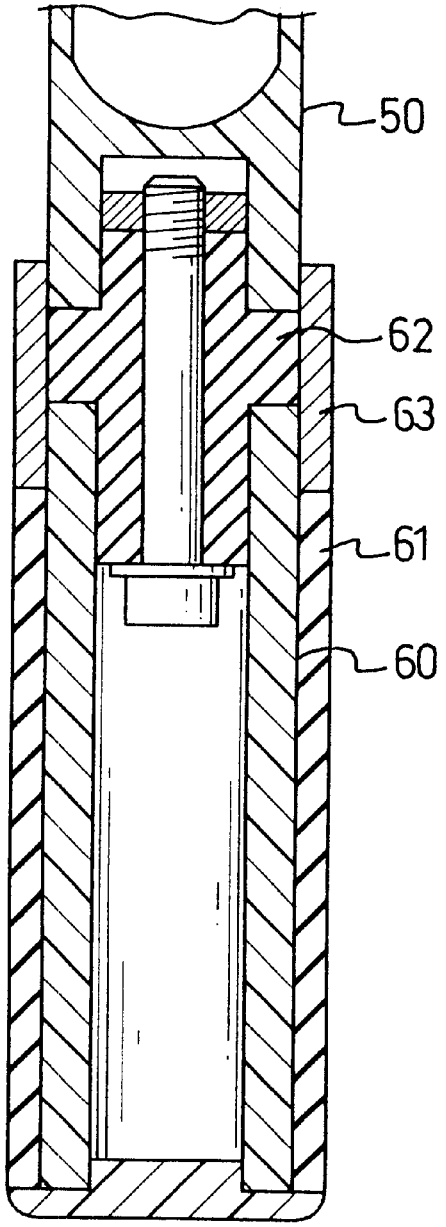
FIG.4A PRIOR ART

With reference to FIG. 3, the elastomer (24) may also be mounted in the neck (10). The elastomer (24) is placed on the inner bottom (120) and align the channel (241) with the inner through hole (121 so that the threaded bolt (13) is able to extend through the aligned channel (241) of the elastomer (24), the inner through hole (121), the outer through hole (111) and the through hole (23) in the bottom of the chamber (21). The nut (25) is screwed onto the threaded bolt (13) to attach the elastomer (24) to the neck (10). Besides, to further enhance the engagement and detachment of the nut (25) and the threaded bolt (13), a recess (26) is defined in the bottom defining the through hole (23). The recess (26) is so configured that after the nut (25) is received in the recess (26), the nut (25) will not rotate when the bolt (13) rotates.

It concludes that the tighter the engagement between the bolt (13) and the nut (25), the more rigid the racket is. That is, the elastomer (24) is forced downward (upward) to further enhance the engagement between the neck and the handle so that the racket of the invention is rigid racket.

A force continuously forcing the neck toward the handle is applied due to the addition and position of the elastomer, which not only secures the entire structure of the racket but also strengthen the shock absorbing effect of the racket of the present invention. The racket of the present invention is able to be disassembled for storage and transportation and the requirements to the size of the handle and the length of the racket can be adapted to different users playing with the same racket.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A tubular handle and a tubular neck for a racket, wherein the neck comprises:

an outer tapered wall provided with an outer bottom formed with the outer tapered wall; and an inner tapered wall provided with an inner bottom formed with the inner tapered wall; and the handle comprises:

a tapered wall defining an open chamber with a bottom and a tapered sidewall to receive the outer bottom of the neck;

an elastomer securely abutting the bottom defining the chamber; and a threaded bolt extending through the inner bottom, the outer bottom, the bottom of the chamber and the elastomer to screw into a nut.

2. The neck and handle for a racket as claimed in claim 1, wherein the outer bottom has a outer through hole and the inner bottom has a inner through hole aligned with the outer through hole and the channel of the elastomer so that the threaded bolt is able to extend through the outer and inner through holes in the outer and inner tapered walls and the channel of the elastomer.

3. The neck and handle for a racket as claimed in claim 2 further comprising an annular cushion configured to be mounted in the chamber and between the neck and the handle.

4. A tubular handle and a tubular neck for a racket, wherein the neck comprises:

an outer tapered wall provided with an outer bottom formed with the outer tapered wall; and an inner tapered wall provided with an inner bottom formed with the inner tapered wall; and the handle comprises:

a tapered wall defining a chamber to receive the outer bottom of the neck;

an elastomer securely abutting a top face of the inner bottom of the neck; and a threaded bolt extending through the elastomer, the inner bottom, the outer bottom, the bottom of the chamber to screw into a nut.

5. The neck and handle for a racket as claimed in claim 4, wherein the outer bottom has an outer through hole and the inner bottom has an inner through hole aligned with the outer through hole and the channel in the elastomer so that the threaded bolt is able to extend through the outer and inner through holes of the outer and inner tapered walls and the channel in the elastomer.

6. The neck and handle for a racket as claimed in claim 5 further comprising an annular cushion configured to be mounted in the chamber between the neck and the handle.

* * * * *